United States Patent [19]

de Polo

[11] Patent Number: 4,533,178

[45] **Date of Patent: * Aug. 6, 1985**

[54] ECCENTRICALLY ROTATABLE CHAIR

[76] Inventor: Harry R. de Polo, 480 Park Ave., New York, N.Y. 10021

[ * ] Notice: The portion of the term of this patent subsequent to Aug. 23, 2000 has been disclaimed.

[21] Appl. No.: 339,466

[22] Filed: Jan. 15, 1982

Related U.S. Application Data

[63] Continuation-in-part of Ser. No. 95,450, Nov. 19, 1979, Pat. No. 4,400,032, Continuation-in-part of Ser. No. 893,685, Apr. 5, 1978, abandoned.

[51] Int. Cl.[3] ..... A47C 3/18

[52] U.S. Cl. ..... 297/349; 297/346; 248/425

[58] Field of Search ..... 297/349, 241, 242, 142, 297/143, 346; 248/425, 240.2, 416

[56] References Cited

U.S. PATENT DOCUMENTS

| | | | |
|---|---|---|---|
| 435,307 | 8/1890 | Hill | 248/240.2 |
| 1,735,304 | 11/1929 | Travis | 248/416 |
| 2,449,385 | 9/1948 | Johnson et al. | 297/241 |
| 2,524,187 | 10/1950 | Boles | 297/241 |
| 2,681,690 | 6/1954 | Johnson et al. | 248/425 X |
| 3,542,326 | 11/1970 | Reapsummer | 248/416 X |
| 3,708,203 | 1/1973 | Barecki et al. | 297/349 |
| 4,400,032 | 8/1983 | de Polo | 248/416 |

FOREIGN PATENT DOCUMENTS

| | | | |
|---|---|---|---|
| 260053 | 7/1949 | Switzerland | 297/291 |

*Primary Examiner*—Francis K. Zugel

*Attorney, Agent, or Firm*—Robert E. Burns; Emmanuel J. Lobato; Bruce L. Adams

[57] ABSTRACT

An eccentrically rotatable chair comprises a base having a horizontal surface and a central support fixedly secured to the base. A horizontal arm extends from the central support and is connected with the support by a longitudinally extending anti-friction lineal bearing in the arm engaging an annular flange on the central support so that the arm can move longitudinally and can rotate about the central support but is restrained from rotation about the longtudinal axis of the arm. A seat is supported at the outer end of the arm and a ball bearing at the outer end of the arm can roll in any direction on the base. With this construction the seat can be moved toward and away from the central support and can orbit around the central support but is maintained upright by the bearing connecting the arm with the central support. In one embodiment the central support is a vertical post with two annular flanges spaced vertically from one another. The arm encloses the post and has two longitudinally extending anti-friction lineal bearings respectively engaging the two flanges of the post.

20 Claims, 17 Drawing Figures

FIG. 1
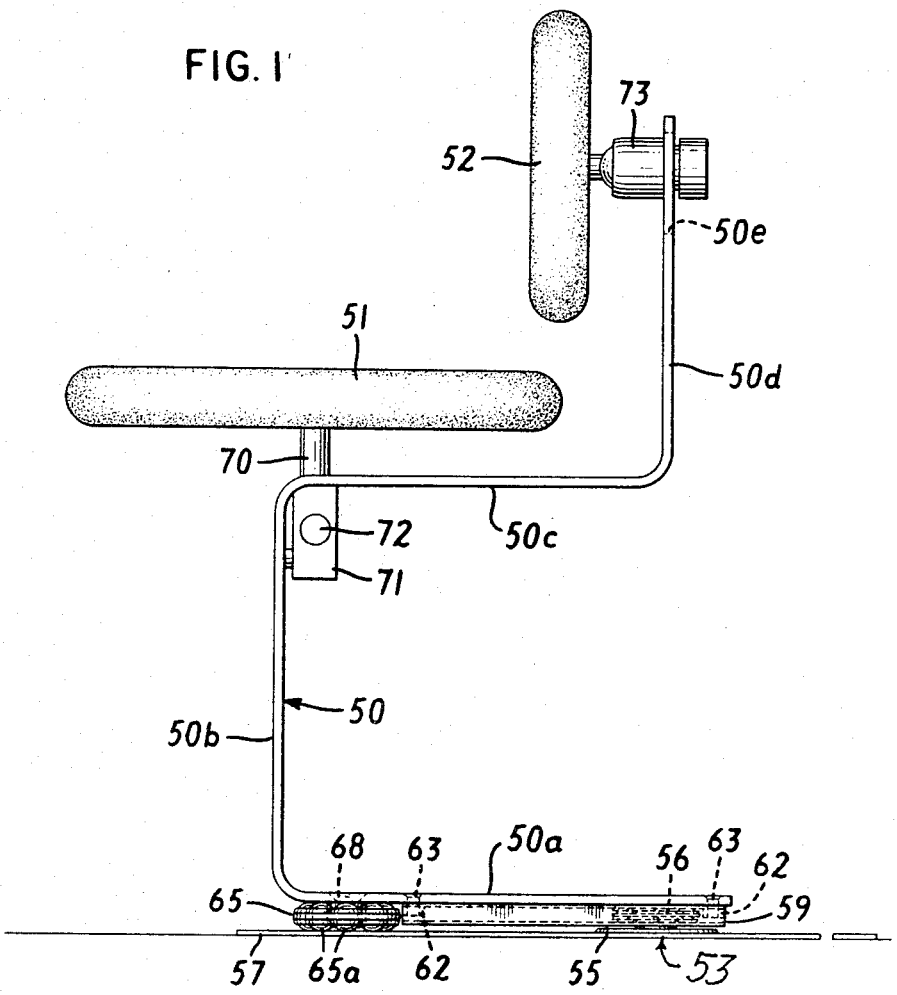
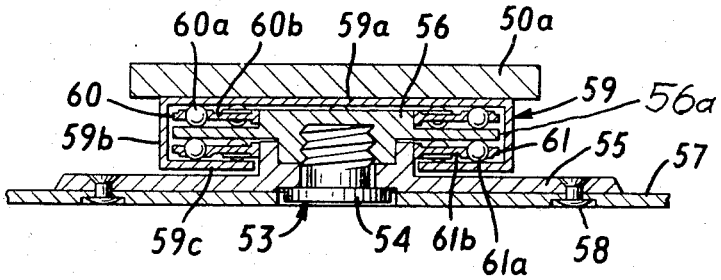
FIG. 4

ECCENTRICALLY ROTATABLE CHAIR

REFERENCE TO PRIOR APPLICATIONS

This application is a continuation-in-part of my U.S. application Ser. No. 095,450 filed Nov. 19, 1979 now patent No. 4,400,032 which was a continuation-in-part of my U.S. application Ser. No. 893,685 filed Apr. 5, 1978 (now abandoned).

FIELD OF INVENTION

The present invention relates to chairs for business and home use and particularly chairs which are mounted for movement eccentrically on a base. The term "chair" is herein used in a generic sense to include stools and other seating devices.

BACKGROUND OF THE INVENTION

Office chairs are customarily supported on four casters each of which comprises a small wheel mounted eccentrically on a spindle. When the chair is moved from one position to another, the caster wheels swing about the spindle axes into alignment with the direction of movement and roll along the floor. If the floor is carpeted, the chair is more difficult to move especially when someone is sitting in the chair and the repeated swinging and rolling movement of the casters soon wears through the floor covering. In order to protect the floor covering, boards of fiber or plastic are provided underneath the chairs. However, these are unsightly and interfere with cleaning. Most stools such as those used for example in drafting offices and most chairs used in the home are not provided with casters. They hence must ordinarily be lifted in order to be moved from one position to another. They can be slid along the floor only with difficulty and with resultant wear of the floor covering. For example when a person wishes to move up to or away from a table he usually moves his chair by a series of jerking, sliding movements. This is hard on the person, the chair and the floor.

SUMMARY OF THE INVENTION

It is an object of the present invention to provide a chair which is very comfortable and is easily movable from one position to another. In accordance with the invention, a chair seat is mounted at the outer end of a horizontal arm extending from a central support which is secured to a base having a horizontal surface. A single roller support assembly at the outer end of the horizontal arm is rollable in all directions on the base and supports the outer end of the arm. The arm is connected with the central support in such manner that it can move freely in a longitudinal direction relative to the central support and can rotate freely about the central support but is restrained from rotation about its own horizontal axis. The connection between the arm and the central support thus keeps the chair in an upright position while permitting the seat to be moved toward or away from the central support and also to move in an orbit about the central support.

In one embodiment of the invention the central support has an annular horizontal flange and the arm has parallel longitudinally extending channels in which the flange is received with antifriction bearing means between the flange and the channels so as to provide for easy movement of the arm in a longitudinal direction and also rotation of the arm about the central support.

In another embodiment the central support comprises a post extending up from the base and having two flanges spaced vertically from one another. The arm has a height sufficient to enclose the post and has two lineal antifriction bearings extending longitudinally of the arm and spaced vertically from one another so as to engage the two flanges respectively. The chair is thereby held upright while being freely movable in all directions on the base. In both of these embodiments the weight of the chair and any occupant is supported by the central support and by the antifriction roller assembly at the outer end of the arm.

Chairs in accordance with the invention may take a variety of forms. They may for example be office chairs with a seat and back rest, with or without arms. They may be stools provided with a footrest but without arms or back. They may be chairs suitable for use in the home for example as dining chairs, easy chairs or occasional chairs. The chairs in accordance with the invention may thus be in a variety of shapes and sizes.

BRIEF DESCRIPTION OF DRAWINGS

The nature, objects and advantages of the invention will be more fully understood from the following description of preferred embodiments shown by way of example in the accompanying drawings in which:

FIG. 1 is a side elevation of a chair in accordance with the present invention having a seat and back but no arms;

FIG. 4 is a vertical section taken approximately on the line 4—4 in FIG. 3;

DESCRIPTION OF PREFERRED EMBODIMENTS

Figure 2:
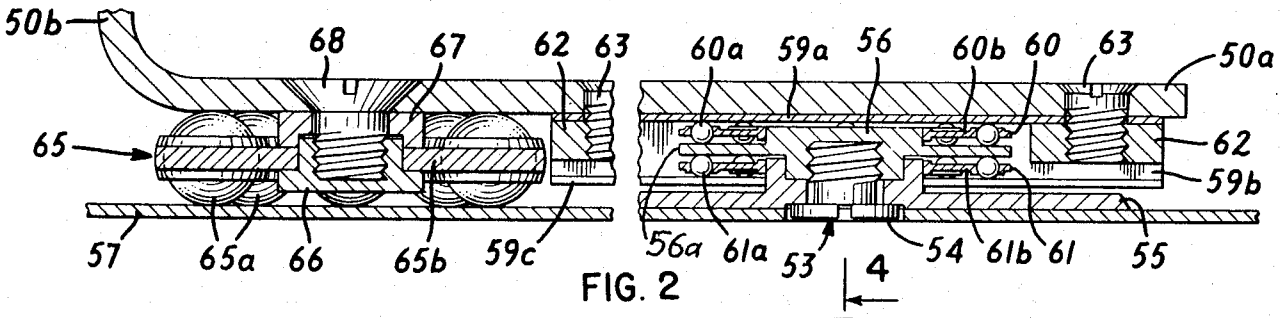
FIG. 2 is an enlarged vertical partial section taken approximately on the line 2—2 in FIG. 3.

In FIGS. 1–4 there is shown a chair in accordance with the invention having a seat and a back rest but no arms. The chair comprises a main support member 50 having a lower horizontal arm portion 50*a*, an upright portion 50*b* supporting a seat 51 and an upper horizontal arm 50*c* and vertical portion 50*d* for supporting a back 52. The lower horizontal arm portion 50*a* is connected with a central pivot post 53 in such manner that it can move longitudinally as a whole relative to the pivot post and is also rotatable through 360° about a vertical axis of rotation defined by the pivot post. As shown in FIG. 4, the central pivot post 53 comprises a strong threaded stud 54 which extends through a central hole in a fitting 55 and is screwed into a circular bearing plate 56 having an annular flange 56*a*. The fitting 55 is integral with a base plate 57 or is secured to it, for example by rivets 58. If it is not desired to move the chair from one location to another, the fitting 55 can be secured directly to the floor, for example by screws or bolts, whereupon the floor serves as a base for the chair.

A hollow elongated channel member 59 secured on the lower side of the horizontal arm portion 50*a* of the main support member 50 has a horizontal web portion 59*a*, downwardly extending vertical portions 59*b* and in-turned flange portions 59*c* thereby forming opposite channels which face one another. As seen in FIG. 4, the central pivot post 53 extends up into the channel of the member 59. The annular flange 56*a* of the bearing plate 56 is received in the channels between the horizontal web portion 59*a* and the in-turned flange portions 59*c* as seen in FIG. 4. A ball bearing 60 comprising a plurality of balls 60*a* in an annular retainer 60*b* is interposed between the flange 56*a* of the bearing plate 56 and the web portion 59*a* of the channel member 59. A similar ball bearing 61 comprising a plurality of balls 61*a* in an annular retainer 61*b* is interposed between the flange 56*a* of the bearing plate 56 and the in-turned flange portions 59*c* of the channel member 59. The ball bearings 60 and 61 permit free rotation of the main support member 50 through 360° relative to the central pivot post 53.

Moreover, the elongate channel of the member 59 permits movement of the main support member 50 as a whole relative to the central pivot post in a direction longitudinal of the lower horizontal arm portion 50*a* so that the upright portion 50*b* supporting the seat 51 can be moved closer to or farther away from the vertical axis of rotation. Such longitudinal movement is limited by stop bars 62 which are inserted into end portions of the channel member 59 and secured by screws 63 which also secure channel member 59 to the horizontal arm portion 50*a* of the main support member 50. Since the bearing plate 56 of the pivot post 53 is rigid and is rigidly secured to the base, tilting or rocking of the arm portion 50*a* of the main support member 50 about a horizontal axis is prevented. The support portion 50*b* of the main support member 50 is thereby held in an upright position.

At the outer end of the horizontal arm portion 50*a* of the main support member 50 there is provided a single rolling support which takes vertical loads and thereby supports the support portion 50*b* and seat 51 together with the load imposed by a person sitting on the seat. The rolling support is shown as a ball bearing 65 comprising a plurality of balls 65*a* and an annular retainer 65*b*. The retainer is rotatably mounted on the lower side of the horizontal arm portion 50*a* at the foot of the upright support portion 50*b* by fittings 66 and 67 and a screw 68 which extends through a hole in the arm portion. The balls 65*a* having rolling engagement with the horizontal surface of the base 57 and with the lower face of the outer end portion of the horizontal arm 50*a*. Hence, the retainer 55*b* does not take vertical loads but merely serves to position the balls. While the ball bearing 65 is shown as having eight balls, it will be understood that the number of balls can be varied.

The seat 51 is padded and has a central post 70 mounted in a fixture 71 at the upper end of the vertical support portion 50*b* of the main support member 50. If desired the seat may be rotatable. Alternatively, it may be mounted nonrotatably since the entire chair is rotatable about the central axis defined by the pivot post 53. Preferably, however, it is vertically adjustable relative to the fixture 71 and can be fixed in selected vertical position by means of a knob 72.

The back 52 is padded and is mounted on an upper end portion of the vertical portion 50*d* extending up from the upper horizontal arm 50*c* of the main support member 50 by a universal mounting fixture 73 like that shown in FIG. 1 of patent No. Moreover, the upper end portion of the vertical portion 50*d* is slotted as indicated at 50*e* to permit vertical adjustment of the back.

While the main support member 50 may be tubular, for example of rectangular cross section, it is shown as being a solid bar. It must be tortionally rigid so that the mounting of the main support member on the central pivot post as described above keeps the chair upright. If the main support member is of suitable channel cross section throughout, the additional channel member 59 on the lower horizontal arm portion 50*a* may be unnecessary.

Figure 5:
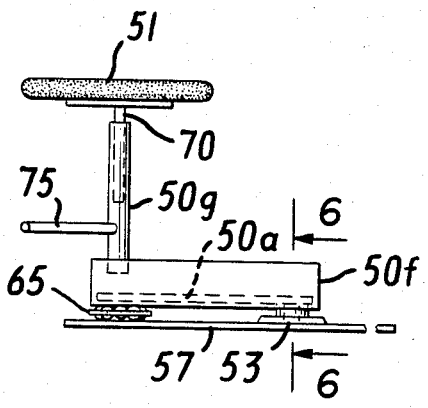
FIG. 5 is a small scale schematic side elevation of another embodiment in the form of a stool having a footrest but no arms or back.
Figure 6:
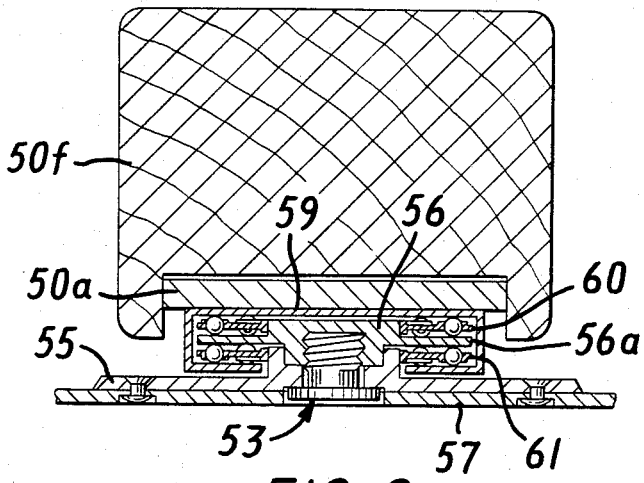
FIG. 6 is an enlarged vertical section taken approximately on the line 6—6 in FIG. 5.

In FIGS. 5 and 6 there is shown another embodiment of the invention in the form of a stool having a seat but no arms or back. As the construction of the embodiment shown in FIGS. 5 and 6 is in general like that shown in FIGS. 1–4, like parts are designated by the same reference numerals. Thus the support for the seat 51 includes a horizontal arm portion 50*a* which is connected with a central pivot post 53 in the manner described above so as to be movable longitudinally and also rotatable about the central pivot post. At the outer end of the horizontal arm portion 50*a* there is a ball bearing 65 adapted to roll in all directions on the base 57.

Figure 7:
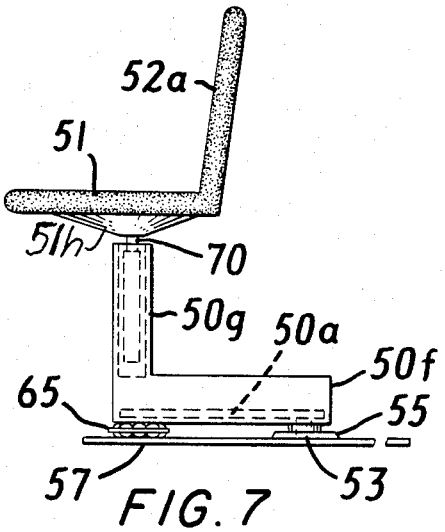
FIG. 7 is a small scale schematic side elevation of a further embodiment in the form of a chair having a back but no arms.

On the horizontal arm portion 50*a* there is superposed a beam 50*f* which is both ornamental and structural. As seen in FIG. 6, the beam 50*f* has dependent side flanges which embrace the lateral edges of the horizontal arm portion 50*a*. The beam 50*f* is formed of any suitable material, for example plastic or wood and may be hollow or may be solid as shown. It is secured to the horizontal arm portion 50*a*, for example by screws or by adhesive, so as to become in effect a part of the horizontal arm. Instead of the horizontal arm being formed of parts 50*a* and 50*f* as shown, it can be an integral member. At the outer end of the horizontal arm and thus above the ball bearing 65, there is an upright support 50*g* which is shown in the form of a circular cylinder. The lower end of the upright support 50*g* extends into and is secured to the beam 50*f* so as to become in effect integral therewith. The seat 51 is supported by a post 70 which extends down into the cylindrical upright 50*g* and forms in effect a piston in the cylinder. As known per se and hence not shown in the drawings, pressure fluid is supplied to the cylinder so as to support the post 70 and hence the seat 51 at a selected height. Moreover, the post 70 is rotatable in the cylinder so as to permit rotation of the seat 51. A footrest 75 is mounted on the upright support 50*g*. It will be understood that the chair shown in FIG. 5 functions in the manner described above with reference to the chair shown in FIGS. 1–4 with the additional feature that the height of the seat can be selected by means of fluid pressure. Alternatively, the height of the seat is adjusted mechanically in known manner, e.g. by the use of a helically threaded spindle. In FIG. 7 there is shown a chair like that of FIG. 5 except that the footrest 75 is omitted and the chair has a padded back 52*a* which is integral with the seat 51. Moreover, in FIG. 7, a housing 51*h* below the seat may in known manner contain adjusting mechanism, for example for tilting the chair.

Figure 8:
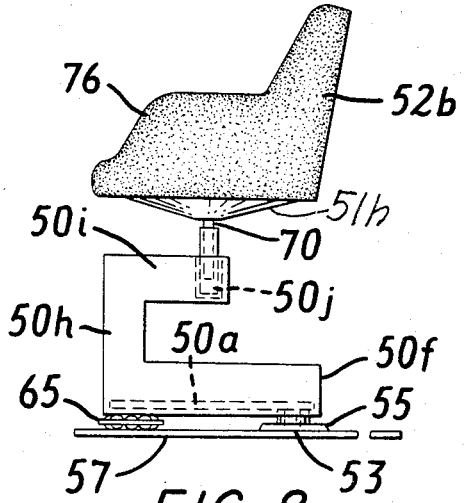
FIG. 8 is a small scale schematic side elevation of an easy chair having integral arms and back.

In FIG. 8 there is shown a chair in which an upright support portion 50*h* extends upwardly from the outer end of the beam 50*f* and an upper arm 50*i* extends from the upper end of the upright portion 50*h* in a direction toward the vertical axis of the central pivot post 53. The upper arm 50*i* and upright 50*h* are integral with the beam 50*f*. The seat is supported by a post 70 which extends as a piston into a cylinder 50*j* formed in an end portion of the upper arm 50*i*. The seat is thus rotatable about the axis of the post 70 and its vertical height can be selected by means of fluid pressure in the cylinder 50*j* or mechanically as described above. The seat is shown provided with an integral padded back 52*b* and padded arms 76. The size of the seat and the length of the upper arm 50*i* are selected so that the legs of a person sitting on the seat are clear of the upright 50*h* when the seat is in the position shown in FIG. 8. The seat can, if desired, be rotated 360° about the axis of the post 70. With the construction shown in FIG. 8 the load imposed by the weight of the seat and a person seated thereon is distributed more or less equally between the ball bearing 65 and the central pivot post 53.

Figure 9:
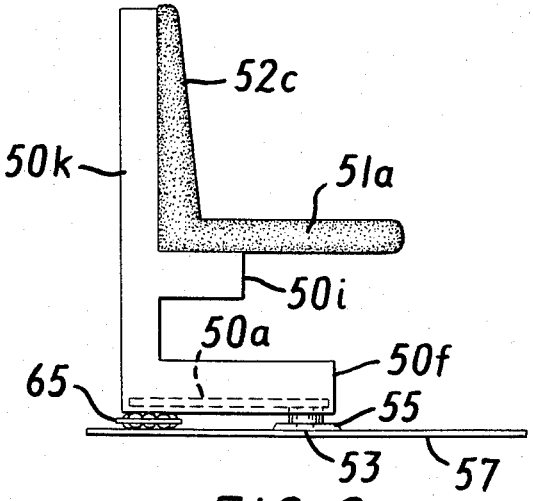
FIG. 9 is a small scale schematic side elevation showing a chair having a back but no arms.

The chair construction shown in FIG. 9 is similar to that of FIG. 8 except that the integral upright 50*k* at the outer end of the beam 50*f* extends above the upper horizontal arm 50*i* and provides a support for the back 52*c* of a chair having a seat 51*a* supported on the upper horizontal arm 50*i*. It will be seen that this provides a very simple structure in which a person sitting in the chair will face toward the vertical axis of the central pivot post 53. As in FIG. 8, the load imposed by a person sitting on the seat 51*a* is divided between the central pivot post 53 and the ball bearing 65 at the outer end of the horizontal arm portion 50*a*. If a person sitting in the chair presses against the back 52*c* in an effort to tilt backwards, the connecting between the horizontal arm portion 50*a* and the central pivot post 53, as described above, prevents vertical movement of the horizontal arm portion and thus prevents the occupant of the chair from tipping over rearwardly.

Figure 10:
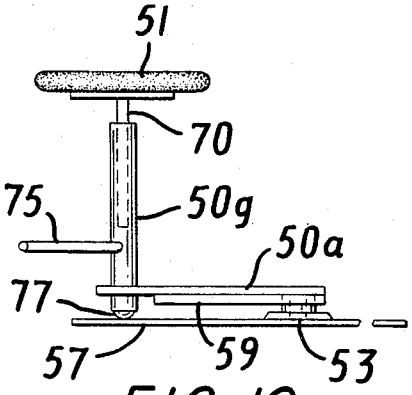
FIG. 10 is a small scale schematic side elevation showing a stool having a footrest but no arms or back.
Figure 11:
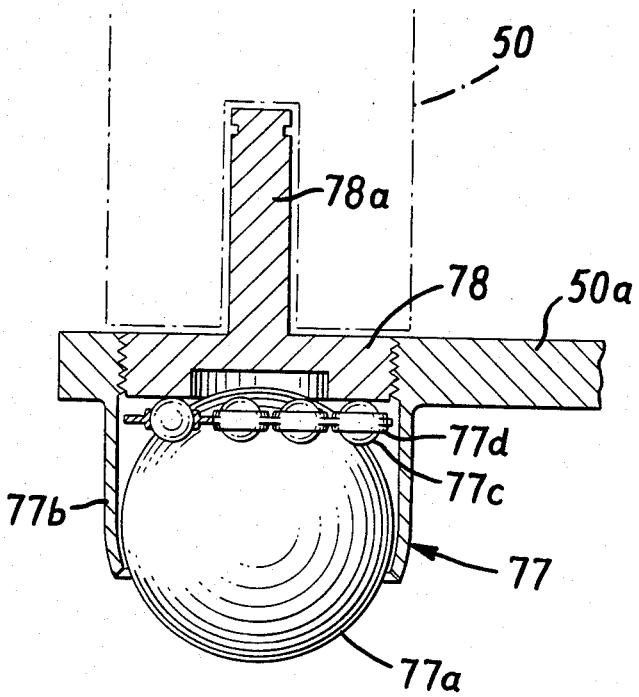
FIG. 11 is an enlarged vertical section of the outer end portion of the arm of the chair shown in FIG. 10, the section being taken longitudinally of the arm.

The embodiment of the invention shown in FIG. 10 is similar to that of FIG. 5 except that the beam 50*f* is omitted and the ball bearing 65 comprising a plurality of balls is replaced by ball bearing 77 having a single relatively large diameter ball 77*a*. As shown in FIG. 11, the ball 77*a* is retained in a cup 77*b* of which the lower end is restricted so as to retain the ball in the cup. The ball 77 bears on a ring of small balls 77*c* held in a circular retainer 77*d* and bearing against the lower face of a screw plug 78. The screw plug 78 has a stem 78*a* which extends up into the lower end of the upright 50*g* which receives the post 70 by which the seat 51 is rotatably supported. As in FIG. 5, there is provided a footrest 75. Although the roller bearing 77 provides only a single area of support on the base 57, the upright member 50*g* is maintained in an upright position by the horizontal arm 50*a* and its connection through the channel member 59 with the central pivot post 53 as described above. Thus the load on the seat 51 is supported by the ball bearing 77 while the chair is maintained upright through the horizontal arm 50*a* and the central pivot post 53.

Figure 12:
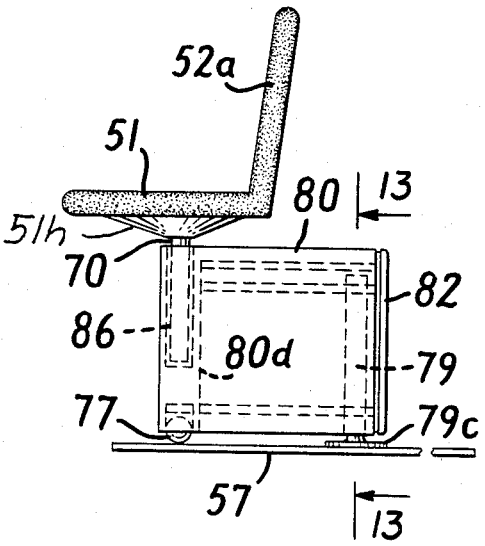
FIG. 12 is a small scale schematic side elevation of another embodiment in which the chair has a back rest but no arms.
Figure 13:
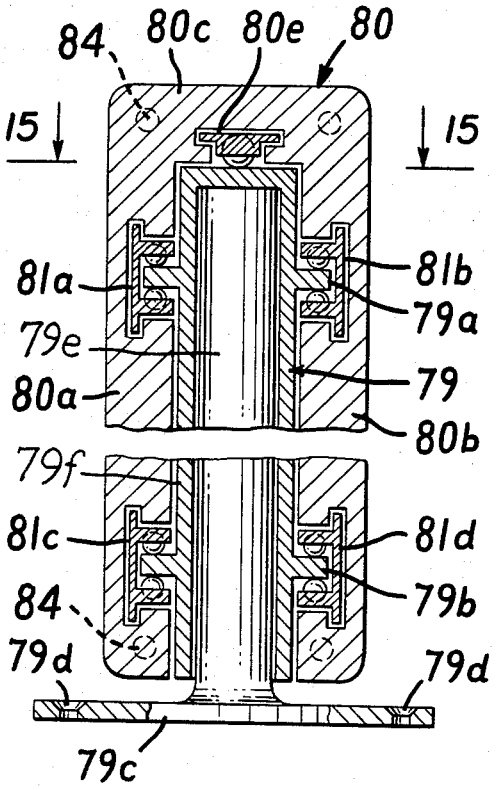
FIG. 13 is an enlarged vertical section taken approximately in the line 13—13 in FIG. 12.
Figure 14:
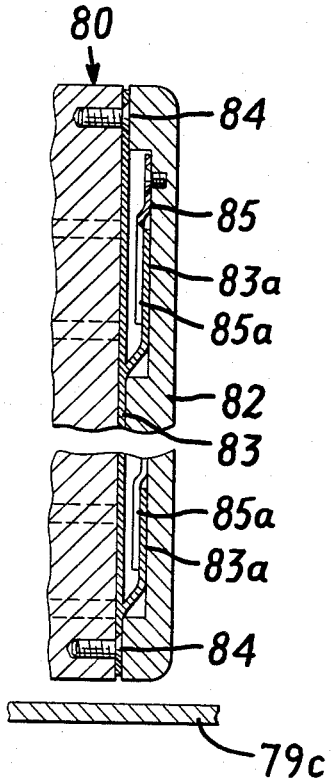
FIG. 14 is a fragmentary vertical section of the inner end of the arm taken in a plane perpendicular to that of FIG. 13.
Figure 15:
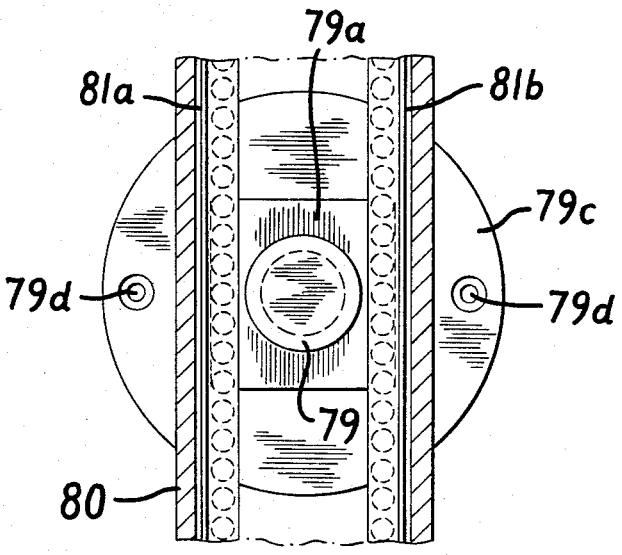
FIG. 15 is a fragmentary horizontal section taken approximately on the line 15—15 in FIG. 13.

In FIGS. 12–15 there is shown an embodiment of the invention in which the central pivot post 79 is higher than in the previously described embodiments and is provided with two annular flanges 79*a* and 79*b* which are spaced vertically from one another. At its lower end the central pivot post 79 is provided with a flange 79*c* through which it is rigidly secured to a base for example through screws, bolts or rivets extending through holes 79*d*. As shown in FIG. 13, the post 79 comprises a stationary core 79*e* secured to the base and a rotatable sleeve 79*f* on which the flanges 79*a* and 79*b* are provided. A horizontal arm 80 has a height at least as great as that of the central pivot post and is formed as a hollow housing or casing having opposite side walls 80*a* and 80*b* between which the central post 79 is received. A pair of lineal ball bearings 81*a* and 81*b* set in channels extending longitudinally of the arm 80 in opposite side walls 80*a* and 80*b* engage the upper flange 79*a* of the central pivot post 79. A second pair of lineal ball bearings 81*c* and 81*d* set in longitudinally extending channels in opposite side walls 80*a* and 80*b* of the horizontal arm 80 engage the lower flange 79*b* of the central pivot post 79. Each of the lineal ball bearings comprises an elongate channel-shaped member having opposite flanges in each of which a row of balls is retained, as seen in FIG. 15, either by the configuration of the flanges or by an appropriate ball retainer. A fifth lineal ball bearing 81*e* set in a longitudinally extending channel in the top portion 80*c* of the horizontal arm 80 engages the upper end face of the central pivot post 79. The upper lineal ball bearing 71*e* comprises a single row of balls in a suitable retainer. Through the construction described, the horizontal arm 80 can move in a longitudinal direction relative to the central pivot post and can rotate freely about the central pivot post but is held against vertical movement and against tilting about its longitudinal axis, thus being maintained in an upright position.

To facilitate assembly of the chair and also subsequent inspection and maintenance, the horizontal arm 80 is provided with a removable closure 82 as shown in FIG. 14. The closure 82 is removably held in place by brackets 83 which are secured by screws 84 to the vertical end faces of the side walls 80*a* and 80*b* of the horizontal arm 80 and provided with upwardly directed spring prongs 83*a*. On the inner face of the closure member 82 there are provided complementary brackets 85 having prongs 85*a* adapted to interengage with the prongs 83*a* of the bracket 83 to hold the end closure 82 in place. The closure can be removed merely by moving it upwardly so as to disengage the prongs 85*a* of bracket 85 from the prongs 83*a* of the bracket 83. This construction permits assembly of the chair by slipping the open end of the arm 80 over the central pivot post 79. The end closure 82 is then secured in place and constitutes not only a closure but also a stop limiting longitudinal movement of the member 80 toward the left as viewed in FIG. 12. Movement in the opposite direction is limited by the end 80*d* of the cavity in the horizontal arm 80.

At the outer end of the horizontal arm 80 there is provided a vertical cylinder 86 which receives the supporting post 70 of a seat 51 having an integral back 52*a*. As previously described, the seat post 70 is rotatable in the cylinder 86 and is also movable vertically to selected position for example by fluid pressure. Also at the outer end of the arm 80 there is a ball bearing 77 which may be of the construction illustrated in FIG. 11 and rolls in all directions on the base 57. The load of a person sitting on the seat 51 is taken primarily by the ball bearing 77 while the chair is maintained in an upright position by the horizontal arm 80 and the central pivot post 79. From the foregoing description it will be understood that the seat 51 is moveable toward and away from the vertical axis of the central pivot post 79 and is also movable in an orbit about the central pivot post by rotation on the central pivot post of the arm 80.

Figure 16:
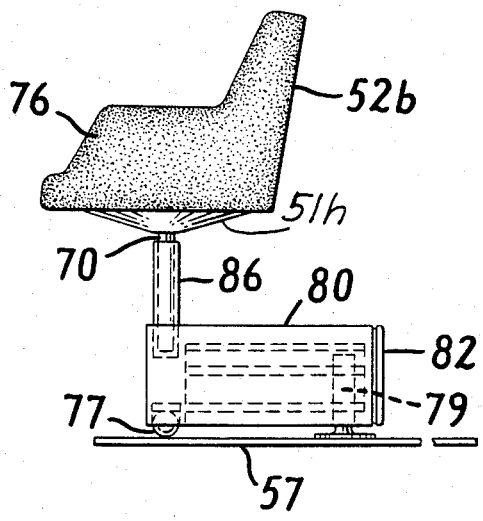
FIG. 16 is a small scale schematic side elevation of a further embodiment of the invention having arms and a back.

In FIG. 16 there is shown another embodiment of the invention which is similar to that shown in FIG. 12 but differs in that the height of the central pivot post 79 and the horizontal arm 80 is somewhat less and that the cylinder 86 for the seat post 70 extends up above the top of the horizontal arm 80. Moreover, the seat is of the form shown in FIG. 8 with a back 52*b* and arms 76. Otherwise the construction and operation of the chair are as described with respect to FIGS. 12–15.

Figure 17:
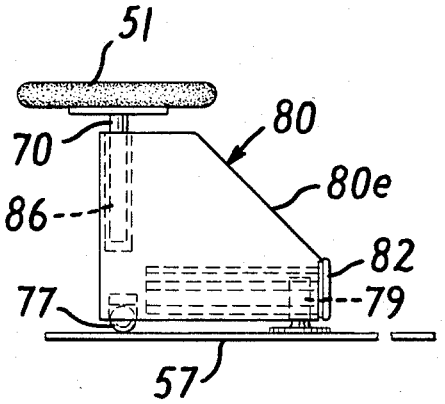
FIG. 17 is a small scale schematic side elevation of a stool in accordance with the invention.

In FIG. 17 there is shown an embodiment of the invention which is similar to that of FIG. 12 except that the central pivot post 79 is somewhat shorter and the horizontal arm 80 is formed with an inclined edge 80*e* which slopes upwardly toward the seat 51. The seat is like that of the embodiment shown in FIG. 5 in that it does not have a back. Otherwise the construction and operation of the embodiment shown in FIG. 17 is like that of the embodiment illustrated in FIGS. 12 and 15.

Figure 3:
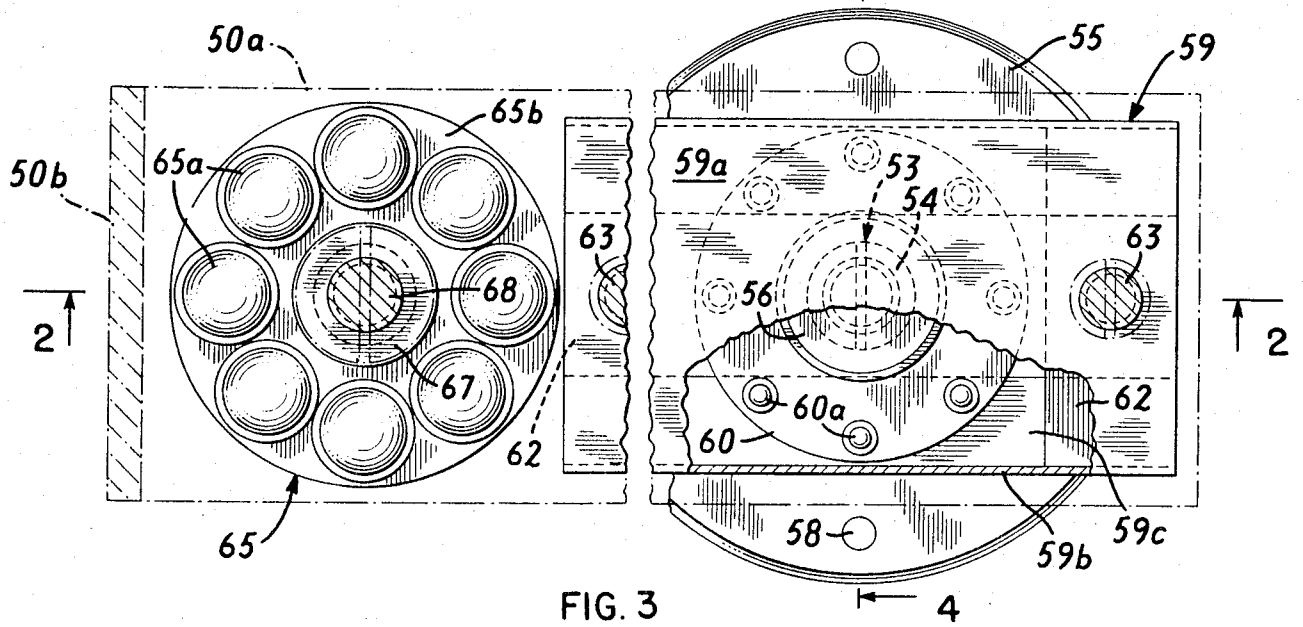
FIG. 3 is an enlarged plan view of a lower part of the chain shown in FIG. 1 with a portion broken out to reduce the length of the figure and with a portion broken away to show internal construction.

While a number of embodiments of the invention have been illustrated by way of example in the drawings, it will be understood that the various features shown can be combined in still other ways. For example the embodiments illustrated in FIGS. 1–9 can have at the outer end of the horizontal arm a ball bearing comprising a single ball as illustrated in FIGS. 1–3. Likewise, the various seat forms can be interchanged and still other seat forms can be used. When the seat is adjustable, this can be by fluid pressure or mechanically, both of which methods are known. Moreover, the seat may be tiltable in known manner. While the embodiments of FIGS. 12 to 17 are shown with two lineal bearings spaced vertically from one another, a single lineal bearing can be used. It will thus be seen that the invention provides virtually unlimited design possibilities for chairs to be used in offices and in homes.

What is claimed is:

1. An eccentrically rotatable chair comprising:

a base having a horizontal surface, central support means fixed on said base and having a vertical axis, an elongated non-extensible horizontal arm embracing and extending horizontally from from said central support means and having a longitudinal axis and an outer end spaced from said central support means, said horizontal arm being hollow and said central support means comprising a pivot post extending up into said hollow arm, single roller support means at said outer end of said arm rollable in all directions on said base and supporting said outer end of said arm, a seat disposed above and supported by said arm, and means connecting said arm with said central support means for rotation of said arm about the vertical axis of said central support means and for movement of said arm as a whole longitudinally relative to said central support means while restraining vertical movement of said arm and rotation of said arm about its longitudinal axis, said central support means and roller support means supporting said arm and seat and any load on said seat.

2. A chair according to claim 1, in which means for supporting said seat extends upwardly from said outer end of said arm, said seat being supported on said upwardly extending seat supporting means.

3. A chair according to claim 2, in which said seat is rotatable on said seat supporting means.

4. A chair according to claim 2, further comprising means for moving said seat vertically and for securing it in selected vertical position.

5. A chair according to claim 2, further comprising a second arm extending horizontally from an upper portion of said seat supporting means, an upright extending upwardly from said second arm and a back mounted on said upright.

6. A chair according to claim 5, in which said back is swivelly mounted on said upright for tilting in all directions.

7. A chair according to claim 1, in which said connecting means comprises a horizontal annular flange on said central support, parallel longitudinally extending channels in said arm receiving said flange and antifriction bearing means between said flange and said channels to restrain upward and downward movement of said arm and rotation of said arm about its longitudinal axis while providing for rotation of said arm about the vertical axis of said central support and for movement of said arm longitudinally.

8. A chair according to claim 1, in which means for supporting said seat comprises an upright extending upwardly from said outer end of said arm and a second shorter arm extending from said upright toward the axis of said central support, said seat being mounted on said second arm.

9. A chair according to claim 1, in which means for supporting said seat comprises an upright extending upwardly from said outer end of said arm, said seat being mounted on said upright and facing said axis of said central support.

10. A chair according to claim 1, in which said arm has a height at least equal to the height of said post and encloses said post.

11. A chair according to claim 10, in which means for supporting said chair comprises a vertical cylinder at the outer end of said arm, and a piston moveable axially in said cylinder, said seat being mounted on an upper end of said piston.

12. A chair according to claim 11, in which said seat is rotatable about the axis of said cylinder.

13. A chair according to claim 10, in which said means connecting said arm with said post comprises a flange on said post and a pair of lineal antifriction bearings extending horizontally in said arm and engaging said flange.

14. A chair according to claim 13, in which said post comprises a stationary core fixed to said base and a sleeve rotatable on said core, said flange being on said rotatable sleeve.

15. A chair according to claim 10, in which said means connecting said arm with said post comprises two flanges on said post spaced vertically from one another and two pairs of lineal antifriction bearings extending horizontally in said arm and spaced vertically from one another, said pairs of lineal bearings engaging said flanges respectively.

16. An eccentrically rotatable chair comprising:

a base having a horizontal surface, central support means on said base and having a vertical axis, an elongated non-extensible horizontal arm embracing and extending from said central support means and having a longitudinal axis and an outer end spaced from said central support means, said horizontal arm being hollow and said central support means comprising a pivot post extending up into said hollow arm, a vertical cylinder fixed at the outer end of said horizontal arm, a seat post rotatable and vertically movable in said vertical cylinder, a seat mounted on and supported by said seat post, single roller support means at the outer end of said horizontal arm rollable in all directions on said base and supporting said outer end of said arm, said seat post and said seat, and means connecting said arm with said central support means for rotation of said arm about the vertical axis of said central support means and for movement of said arm as a whole longitudinally relatively to said central support means, while restraining rotation of said arm about its longitudinal axis and thereby maintaining said cylinder and seat post vertical.

17. An eccentrically rotatable chair according to claim 16, in which said single roller support means comprises a single spherical ball rotatable in a socket.

18. An eccentrically rotatable chair according to claim 16, in which said single roller support means comprises a cluster of balls.

19. An eccentrically rotatable chair according to claim 16, in which said pivot post has vertically spaced annular flanges thereon and in which said means connecting said arm with said central support means comprises lineal ball bearings set in longitudinally extending channels in said arm and engaging said flanges respectively.

20. An eccentrically rotatable chair according to claim 16, in which said pivot post has an annular flange thereon, and in which said means connecting said arm with said central support means comprises lineal ball bearings set in longitudinally extending channels in said arm and engaging said flange.

* * * * *